US010095175B1

(12) United States Patent
Carpenter et al.

(10) Patent No.: US 10,095,175 B1
(45) Date of Patent: Oct. 9, 2018

(54) REMOVING RESIDUAL TONER FROM END SEAL REGIONS OF A DEVELOPER ROLL OF AN IMAGING DEVICE

(71) Applicant: LEXMARK INTERNATIONAL, INC., Lexington, KY (US)

(72) Inventors: Brian Scott Carpenter, Lexington, KY (US); Randall Lee Hudson, Lexington, KY (US); John Lemaster, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/806,540

(22) Filed: Nov. 8, 2017

(51) Int. Cl.

| | |
|---|---|
| ***G03G 21/00*** | (2006.01) |
| ***G03G 15/09*** | (2006.01) |
| ***G03G 15/00*** | (2006.01) |
| ***G03G 15/08*** | (2006.01) |
| ***G03G 15/095*** | (2006.01) |

(52) U.S. Cl.
CPC ..... *G03G 21/0011* (2013.01); *G03G 15/0898* (2013.01); *G03G 15/095* (2013.01); *G03G 15/50* (2013.01)

(58) Field of Classification Search
CPC ..... G03G 15/0898; G03G 15/0817; G03G 21/0005
See application file for complete search history.

(56) References Cited

U.S. PATENT DOCUMENTS

| | | | | |
|---|---|---|---|---|
| 6,256,466 | B1 * | 7/2001 | Ota | G03G 15/0898 399/103 |
| 2013/0236217 | A1 * | 9/2013 | Nagatomo | G03G 9/08 399/281 |
| 2014/0334835 | A1 | 11/2014 | Toyoizumi et al. | |
| 2017/0082949 | A1 * | 3/2017 | Castle | G03G 15/0881 |

* cited by examiner

*Primary Examiner* — Gregory H Curran

(57) ABSTRACT

A developer roll includes end seal regions subject to accumulating residual toner. An adjacent photoconductive member has a longitudinal extent with a central area defining an imaging region and longitudinal ends outside the central area defining non-imaging regions. The photoconductive member has a length extending beyond a length of the developer roll so that the end seal regions of the developer roll contact the non-imaging regions of the photoconductive member. During cleaning, the non-imaging regions become charged and discharged to electrostatically attract and transfer away the toner from the end seal regions. A blade scrapes clean the toner from the photoconductive member.

12 Claims, 5 Drawing Sheets

REMOVING RESIDUAL TONER FROM END SEAL REGIONS OF A DEVELOPER ROLL OF AN IMAGING DEVICE

FIELD OF THE INVENTION

The present invention relates to removing residual toner from a developer roll of an imaging device. More particularly, it relates to discharging areas of an adjacent photoconductive (PC) member to electrostatically attract to non-imaging regions of the PC member residual toner from the developer roll.

BACKGROUND

In the electrophotographic printing process, an imaging device selectively discharges a uniformly charged photoconductive member to form a latent image. Toner makes visible the latent image on the PC member and is transferred to a recording medium for hard copy output. Toner is supplied to the imaging device by a toner cartridge and often comes packaged as a customer replaceable unit (CRU). The CRU bundles together the PC member, charge roll, developer roll, doctor blade, and toner reservoir. Alternatively, it bundles only the developer roll, doctor blade and toner reservoir which mates in the imaging device to the PC member and charge roll which are already semi-permanently installed. Seals are provided to keep toner from leaking and migrating to undesired locations in the imaging device which could disrupt function and affect print quality.

Toner that accumulates on the developer roll at end seals causes some manufacturers to provide ridges or corrugation to direct toner toward away from the seals back to cleaning areas of the PC member. These features, however, add cost to the production of the developer roll and in turn, add cost to the CRU. A need exists to more economically remove unwanted toner from near the end seals. Additional benefits and alternatives are sought when devising solutions.

SUMMARY

The above and other problems are solved by systems and methods to remove residual toner in an imaging device. A developer roll includes end seal regions subject to accumulating residual toner. An adjacent photoconductive member has a longitudinal extent with a central area defining an imaging region and longitudinal ends outside the central area defining non-imaging regions. The photoconductive member has a length extending beyond a length of the developer roll so that the end seal regions of the developer roll contact the non-imaging regions of the photoconductive member. During cleaning, the non-imaging regions become charged and discharged to electrostatically attract and transfer away the toner from the end seal regions. A blade scrapes clean the toner from the photoconductive member. A controller initiates cleaning after completion of an imaging operation, between adjacent scan lines, after development of a predetermined number of pixels, between pages, or at other relevant times. A memory in communication with the controller stores relevant values. A toner patch on the photoconductive member assists in determining the boundary between the imaging and non-imaging regions.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that changes may be made without departing from the scope of the invention. The following detailed description, therefore, is not to be taken in a limiting sense and the scope of the invention is defined only by the appended claims and their equivalents. In accordance with the features of the invention, systems and methods are described for removing residual toner from end seal regions of a developer roll in an imaging device.

Figure 1:
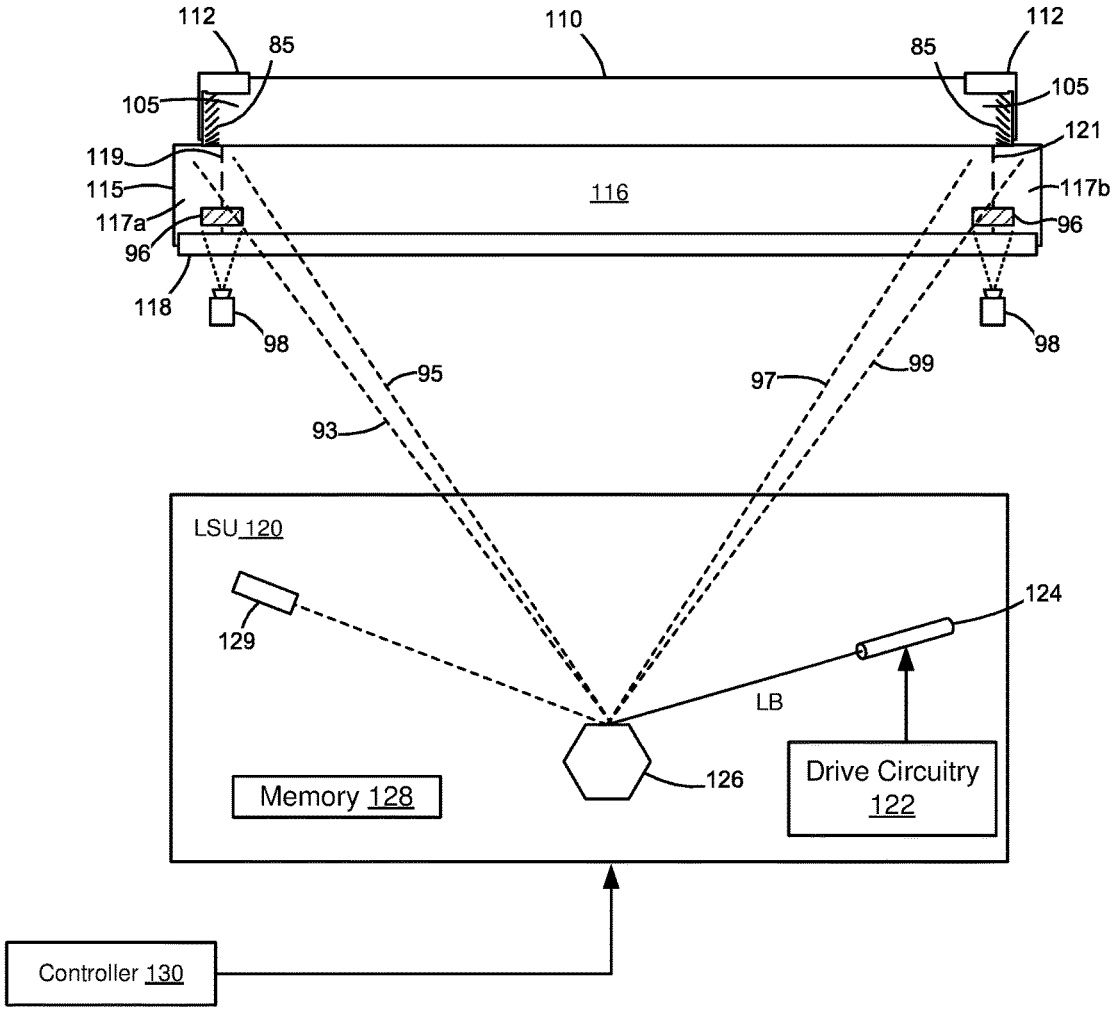
FIG. 1 is a diagrammatic view of an image development system of an imaging device according to an example embodiment.
Figure 2:
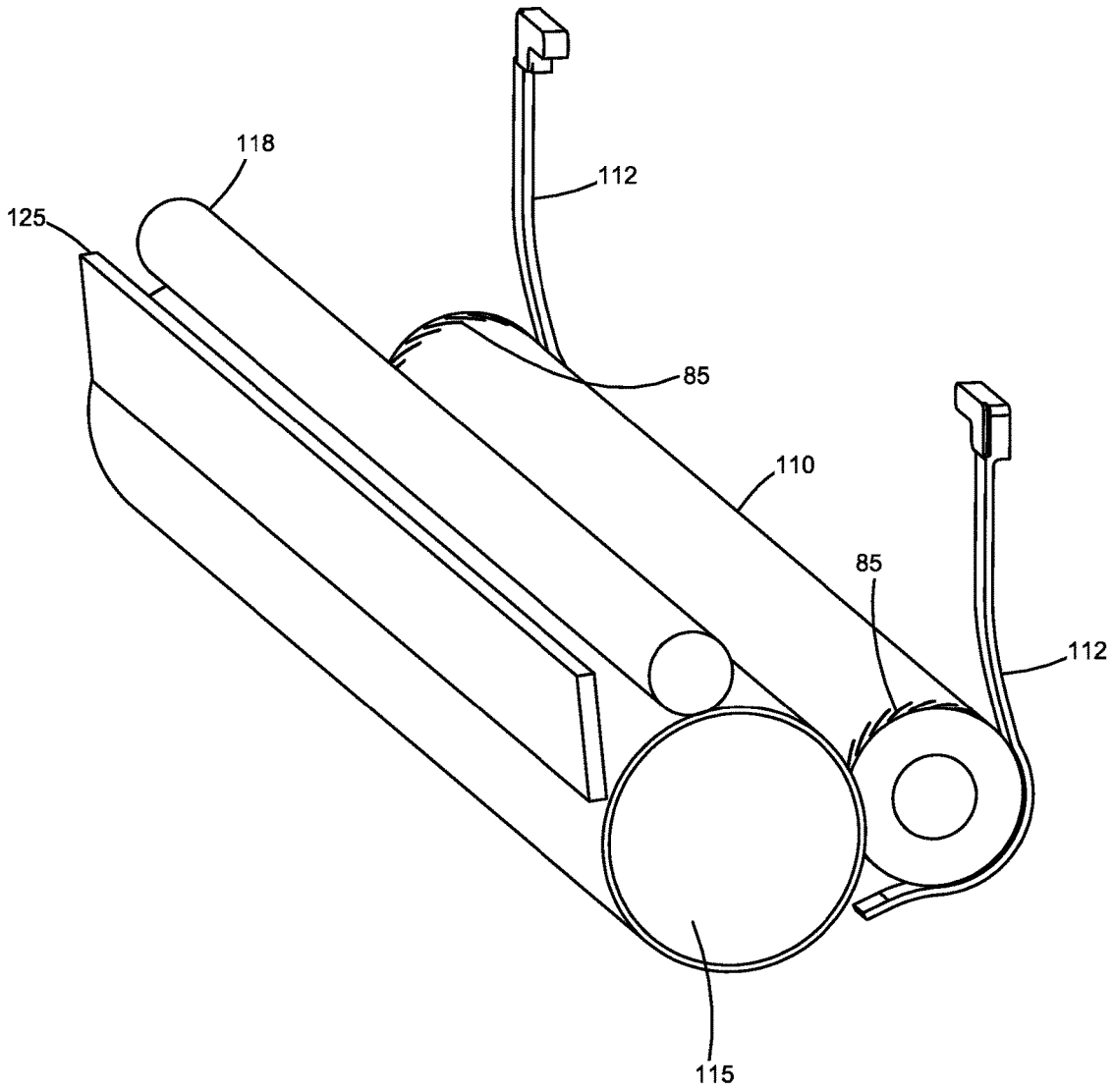
FIG. 2 is a perspective view of a developer roll and end seals, including adjacent charge member, photoconductive member and cleaning blade.

FIGS. 1 and 2 show image development system 100 of an imaging device for developing a toned image during an imaging operation. The system includes a controller 130 that receives image data for producing a hard copy output on a sheet of media. The controller, such as an ASIC(s), circuit(s), microprocessor(s), or the like, causes the activation of a laser beam LB to modulate in a laser scan unit (LSU) 120 according to the image data. It connects to driver circuitry 122 that applies relevant signals and power to a light source 124, such as a laser diode. The laser beam reflects off a multi-faceted mirror 126 (alternatively, torsional oscillator) and is scanned across the surface of a photoconductive member 115, as is familiar. The surface of the photoconductive member is charged by a roller 118 to a generally uniform voltage and, as the laser beam is scanned (e.g., beams 95, 97) it discharges pixels of data to form a latent image on the photoconductive member corresponding to the image data. The pixels of data electrostatically attract toner (not shown) from the developer roll 110 to create a toned image on the PC member, as is also familiar. The toned image is then transferred to an intermediate transfer member, such as a belt, or to a sheet of media. Residual toner on the photoconductive member is scraped clean by blade 125 and deposited into a waste toner reservoir.

Unfortunately, some unwanted toner particles 85 become deposited at end seal regions 105 of the developer roll 110. To clean this away, the image development system 100 discharges non-imaging regions 117*a*, 117*b* of the PC member 115 and electrostatically attracts away the toner. The cleaning occurs during times between imaging operations, between scan lines of imaging operations, or during inter-page gaps as will be described more later. Once transferred, the toner can be scraped clean from the PC member by blade 125.

Figure 3:
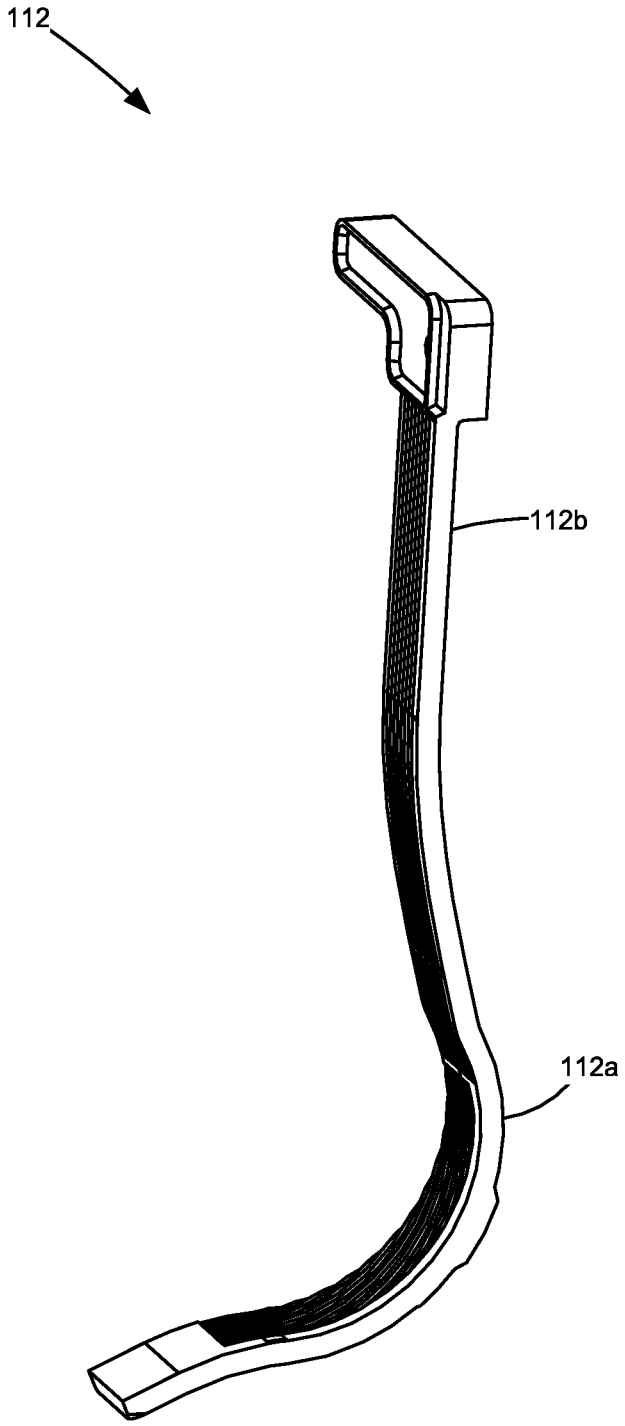
FIG. 3 is a perspective view of a J-shaped end seal.

The cylindrical portions of developer roll 110 that contact end seals 112 as developer roll 110 rotates define the end seal regions 105. The end seals 112, in turn, are those structures contacted onto terminal ends of the developer roll that prevent toner from leaking out of the junction between the developer roll and the toner reservoir. As seen in FIG. 3, an end seal is represented by that disclosed in U.S. Pat. No.

6,487,383 and is incorporated herein by reference. It includes both a rotary seal portion 112*a* and a blade seal portion 112*b*. The rotary seal portion seals the space formed between a frame member (not shown) and developer roll 110. It contacts the end seal regions 105 as developer roll 110 rotates. The seal also includes a means for biasing the rotary seal portion against the surface of the developer roll, such as a cantilever beam, cantilever spring, or foam strip on the face of the rotary seal portion which is facing away from the surface of the rotary member. The blade seal portion 112*b*, on the other hand, seals the space formed between the frame member and the blade member (generally the doctor blade) in the image forming apparatus. The blade seal portion of the seal is generally formed such that it is held in place between the blade member and the frame member when positioned in use. The biasing means also biases the blade seal portion 112*b* against the blade member.

With reference back to FIGS. 1 and 2, the non-imaging regions 117*a*, 117*b* of the PC member 115 consist generally of the terminal ends of the photoconductive member outside of the dashed lines 119, 121 where the imaging device does not produce latent images during imaging operations. They are generally located outside of the imaging region 116 of the PC member toward respective ends and contact the end seal regions 105 of developer roll 110 as both the developer roll 110 and photoconductive member 115 rotate. Also, the photoconductive member 115 is lengthier than developer roll 110 to ensure that an entire length of the developer roll contacts the photoconductive member so that that the end seal regions 105 can become cleaned. The imaging region 116 of the photoconductive member 115, on the other hand, exists more centrally to the photoconductive member and extends between dashed lines 119 and 121 where latent images are formed during use. The imaging region 116 extends on the PC member for at least a distance corresponding to the width of the largest sheet of media the image development system 100 is capable of processing. A length of the sheet of media travels in the imaging device in a direction transverse to the width, e.g., the process direction.

The photoconductive member 115 advances or rotates in the process direction such that scan lines are created on photoconductive member 115 with each scan line being separated from the previous scan line by the amount of rotation of photoconductive member 115. To track the scan lines, mirror 126 causes the reflected laser beam LB to strike a horizontal synchronization (hsync) sensor 129. The output of hsync sensor 129 is provided to controller 130 for referencing correct locations of each of the scan lines on the PC member, including referencing a start position of a scan line operation and providing a common reference point for each successive scan line thereafter. The output of hsync sensor 129 may be also used to establish a scan line count, that is, the number of scan lines completed for the image being developed, which may be stored in memory 128.

Figure 4:
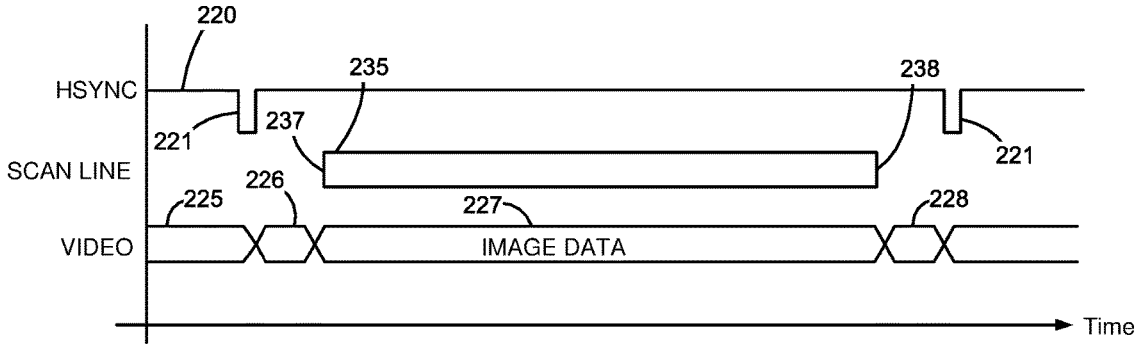
FIG. 4 is a chart illustrating the timing relationship between imaging signals and cleaning signals within a laser scanning unit according to an example embodiment.

With reference to FIG. 4, an example diagram illustrates the timing relationships between the output of the hsync sensor, e.g., hsync signal 220, a video signal 225, and a representative scan line 235 for cleaning end seals between an interpage gape of an imaging operation. With respect to scan line 235, the horizontal dimension represents the physical position, or spot location, of laser beam LB on photoconductive member 115 relative to time. Scan line 235 is understood to be within the imaging region 116 of photoconductive member 115.

In the example shown, hsync signal 220 has an hsync pulse 221 with a rising edge that coincides with the laser beam LB striking hsync sensor 129. After a predetermined amount of time has elapsed after receipt of the hsync pulse 221, the controller initiates an end seal region 105 cleaning operation to discharge non-imaging region 117*a* to remove residual toner from the corresponding end seal region 105 that non-imaging region 117*a* contacts. Video signal 225 includes a first cleaning signal portion 226 provided after hsync pulse 221 and such corresponds to the duration in which light beam LB traverses and discharges non-imaging region 117*a*. After the end seal region 105 cleaning operation, a scan line operation is initiated to write scan line 235. Video signal 225 includes an image data portion 227 provided after cleaning signal portion 226 and it corresponds to the duration of scan line 235 in which image data is written on photoconductive member 115 to form a latent image thereon. Image data portion 227 of video signal 226 contains image data for modulating laser beam LB from a start 237 of scan line 235 to an end 238 thereof. Once the scan line operation is completed, a second cleaning signal portion 228 of video signal 225 triggers a second end seal region 105 cleaning operation. Second cleaning signal portion 228 corresponds to the duration in which light beam LB traverses and discharges non-imaging region 117*b* opposite the non-imaging region 117*a* on the PC member. Discharging non-imaging region 117*b* removes residual toner from the corresponding end seal region 105 that non-imaging region 117*b* contacts. In some embodiments, the power output of light source 124 may be controlled to be higher during the end seal region 105 cleaning operation than that required for a scan line operation and consequently, multiple adjustments are required per scan line. Cleaning the end seal regions 105 may be also performed at other times.

Figure 5:
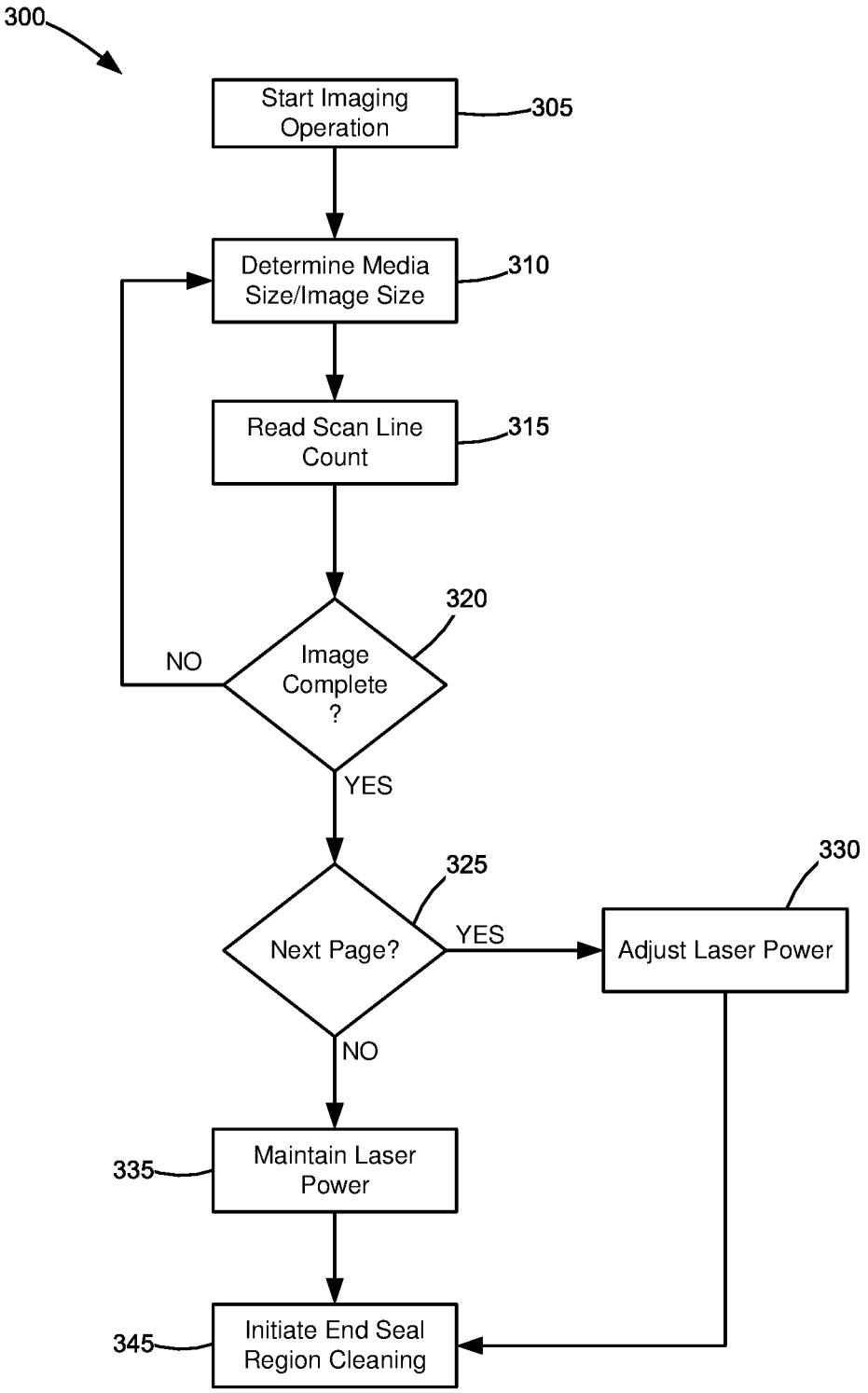
FIG. 5 is a flowchart of an example method of cleaning end seal regions of the developer roll of FIG. 1.

For instance, FIG. 5 (in combination with reference to FIGS. 1 and 2) shows a method 300 whereby controller 130 initiates an imaging operation at 305. At 310, controller 130 determines the size of a media sheet being processed and assumes that the size of the media sheet is equal to the image size of the image being developed. This, along with other information, is sent to driver circuitry 122. LSU 120 then begins to discharge areas on the imaging region 116 of photoconductive member 115 to develop a latent image. The limits of the imaging region 116, however, are dictated by the image size. For instance, an 8.5" by 11" image requires the imaging region 116 to be at least 8.5" along the length of the photoconductive member 115. At 315, controller 130 periodically retrieves the scan line count from memory 128. From the scan line count and the image size, controller 130 determines whether or not the imaging is complete at 320. If so, controller 130 determines at 325 whether another subsequent page exists in the queue. If a subsequent page exists, controller 130 communicates information about the next page and laser modulation data to driver circuitry 122 to adjust the laser power at 330 to that required by the subsequent page. If no subsequent page is queued, laser power is maintained at 335. Controller 130 then initiates cleaning of end seal regions 105 by reactivating LSU 120 with laser beams 93, 99 to discharge non-imaging regions 117*a/b* of photoconductive drum 115 prior to developing the image for the subsequent page, as previously discussed. The discharged non-imaging regions 117 electrostatically attract residual toner particles that are present in the end seal regions 105 of developer roll 110. The residual toner is thus transferred to the non-imaging regions 117 of photoconductive drum 115 to be scraped clean by blade 125.

In other embodiments, the power output of light source 124 may be controlled to be higher during the end seal region 105 cleaning operation than that required for an imaging operation. Typically, the power output of light source 124 may be increased up to twice that of the required power for a typical imaging operation. In such embodiments, controller 130 extends an interpage gap between adjacent sheets of media to allow time for the output of light source 124 to reach the required level for the cleaning operation and return back to the level required for an imaging operation. Alternatively, instead of controlling the power output of light source 124, controller 130 controls LSU 120 to discharge non-imaging regions 117 at every N scan lines (where N=1, 2, 3, 4 . . . ). Alternatively still, controller 130 controls LSU 120 to discharge the non-imaging regions 117 every M pixels (where M=1, 2, 3, 4 . . . ) along every N scan lines (where N=1, 2, 3, 4 . . . ). In still other embodiments, the cleaning operation of end seals occurs after all the pages in a print job are printed or after a predetermined number of pages are printed.

To accurately determine where the end seal regions 105 of developer roll 110 contact the non-imaging regions 117 of photoconductive member 115, the inventors further contemplate developing a toner patch on the imaging region 116 of the photoconductive member 115 adjacent to the non-imaging region 117. The toner patch 96 is laid to purposely cross a possible boundary between the imaging 116 and non-imaging region 117. The size of the toner patch is then measured via one or more cameras 98 or a toner patch sensor (TPS) to determine the position of the non-imaging regions 117, and consequently, the time light beams LB strike the hsync sensor 129 relative to the time the light beams LB start to strike the non-imaging regions 117. This determination may be also performed prior to the developer unit being installed into an imaging device, such as during manufacturing or product initialization.

The foregoing illustrates various aspects of the invention. It is not intended to be exhaustive. Rather, it is chosen to provide the best illustration of the principles of the invention and its practical application to enable one of ordinary skill in the art to utilize the invention. All modifications and variations are contemplated within the scope of the invention as determined by the appended claims. Relatively apparent modifications include combining one or more features of various embodiments with features of other embodiments.

The invention claimed is:

1. In an imaging device, a method to remove residual toner from end seal regions of a developer roll, the end seal regions contacting non-imaging regions of a photoconductive member of the imaging device wherein the non-imaging regions extend between an imaging region of the photoconductive member where latent images become developed during an imaging operation and terminal ends of the photoconductive member, comprising:

discharging the non-imaging regions of the photoconductive member;

electrostatically transferring residual toner from the end seal regions of the developer roll onto the discharged non-imaging regions of the photoconductive member; and removing the transferred residual toner from the non-imaging regions of the photoconductive member.

2. The method of claim 1, further including charging the non-imaging regions of the photoconductive member with a charge member.

3. The method of claim 1, further including accessing a memory having stored therein a scan line count value, wherein scanning a laser beam across the photoconductive member defines a scan line and the scan line count value is a tallied number of scan lines; and determining whether an imaging operation has been completed based upon said scan line count value.

4. The method of claim 1, further including discharging the non-imaging regions of the photoconductive member between scan lines of a laser beam scanning across the photoconductive member during an imaging operation.

5. The method of claim 1, further including discharging the non-imaging regions of the photoconductive member between a predetermined number of pixels for every scan line of a laser beam scanning across the photoconductive member during an imaging operation.

6. The method of claim 1, accessing a memory having stored therein an image size of a latent image being developed on the imaging region of the photoconductive member during an imaging operation; and using said image size to determine whether the imaging operation has been completed.

7. The method of claim 1, further including increasing a power output of a laser beam to a value higher than that used during a previous imaging operation prior when said discharging the non-imaging regions.

8. The method of claim 1, further including delaying the discharging of the non-imaging regions of the photoconductive member until after executing a predetermined number of imaging operations.

9. The method of claim 1, further including discharging the non-imaging regions of the photoconductive member during an interpage gap of adjacent sheets of media.

10. The method of claim 1, further including scraping with a blade the transferred residual toner from the photoconductive member.

11. The method of claim 1, further including measuring a toner patch on the photoconductive member to determine a boundary between the imaging and the non-imaging regions.

12. The method of claim 11, further including measuring the toner patch with a camera.

* * * * *